US012232581B2

(12) United States Patent
Cluzeau

(10) Patent No.: US 12,232,581 B2
(45) Date of Patent: Feb. 25, 2025

(54) JEWEL AND/OR JEWELLERY ARTICLE COMPRISING A FRAME AND AT LEAST ONE FLAP SLIDING WITH RESPECT TO THE FRAME

(71) Applicant: HERMES SELLIER, Paris (FR)

(72) Inventor: David Cluzeau, Charenton le Pont (FR)

(73) Assignee: HERMES SELLIER, Paris (FR)

( * ) Notice: Subject to any disclaimer, the term of this patent is extended or adjusted under 35 U.S.C. 154(b) by 0 days.

(21) Appl. No.: 18/347,441

(22) Filed: Jul. 5, 2023

(65) Prior Publication Data

US 2024/0008604 A1 Jan. 11, 2024

(30) Foreign Application Priority Data

Jul. 6, 2022 (FR) ..... 2206918

(51) Int. Cl.
*A44C 25/00* (2006.01)

(52) U.S. Cl.
CPC ..... *A44C 25/001* (2013.01)

(58) Field of Classification Search
CPC ... A44C 25/001; A44C 25/002; A44C 25/004; A44C 17/0241
See application file for complete search history.

(56) References Cited

U.S. PATENT DOCUMENTS 253,668 A 2/1882 Blaney
263,893 A 9/1882 Goldsmith
1,082,679 A * 12/1913 Conner ..... A63H 33/00 446/28
1,342,035 A 6/1920 Harry
2,146,239 A 2/1939 Weed
3,377,818 A 4/1968 Marek
5,138,779 A * 8/1992 Earnest ..... A44B 1/04 446/14
6,441,746 B1 * 8/2002 Taborisskiy ..... G08B 5/24 324/171

OTHER PUBLICATIONS

Search Report and Written Opinion of FR Application No. 2206918 dated Feb. 17, 2023, 8 pages.

* cited by examiner

*Primary Examiner* — Jack W Lavinder
(74) *Attorney, Agent, or Firm* — NIXON & VANDERHYE

(57) ABSTRACT

A jewel and/or jewellery article includes a frame, a flap able to move with respect to the frame, configured to admit a first configuration wherein the flap at least partially covers the frame and at least one ornamental element that it includes, and a second configuration wherein the flap at least partially uncovers the frame and the ornamental element, a drive mechanism configured to cause to slide on the frame, in a first sliding direction, the at least one flap between a first position in the first configuration of the article and a second position in the second configuration of the article, and an actuation mechanism configured to act on the drive mechanism when the actuation mechanism is urged in a second actuation direction different from the first sliding direction.

20 Claims, 7 Drawing Sheets

JEWEL AND/OR JEWELLERY ARTICLE COMPRISING A FRAME AND AT LEAST ONE FLAP SLIDING WITH RESPECT TO THE FRAME

CROSS-REFERENCE TO RELATED APPLICATIONS

This application claims priority to FR Patent Application No. 2206918 filed Jul. 6, 2022, the entire contents of which are hereby incorporated by reference.

TECHNICAL FIELD OF THE INVENTION

The present invention relates to a jewel and/or jewellery article.

It may for example be an article of the necklace or pendant type.

PRIOR ART

Jewel or jewellery articles are known, in particular of the necklace or pendant type, comprising one or more decorative elements such as precious or semi-precious stones.

There are jewellery articles comprising a support and one or more elements able to move with respect to the support so as to cover and uncover one or more ornamental patterns attached in the support by actuating the movable element or elements. In particular, it may be a case of one or more flaps mounted articulated with respect to the base and admitting a first configuration wherein they cover the ornamental patterns and a second configuration wherein they reveal ornamental patterns.

SUMMARY OF THE INVENTION

The invention aims to provide a jewel and/or jewellery article configured to adopt several configurations so as to be able to vary the ornamental patterns presented by the article.

The object of the invention, in a first aspect, is thus a jewel and/or jewellery article including a frame and at least one flap able to move with respect to the frame, with the article being configured to admit a first configuration wherein the flap at least partially covers the frame and at least one ornamental element that it includes, and a second configuration wherein the flap at least partially uncovers the frame and said at least one ornamental element, the article including a drive mechanism configured to cause the at least one flap to slide on the frame, in a first sliding direction, between a first position in the first configuration of the article and a second position in the second configuration of the article, and an actuation mechanism configured to act on the drive mechanism when the actuation mechanism is actuated in a second actuation direction different from the first sliding direction.

In the jewel and/or jewellery article according to the invention, when the actuation mechanism is actuated, the latter acts on the drive mechanism, which itself acts on one or more flaps to cause them to pass from one to the other of the first position and second position, thus bringing this article from one to the other of the first configuration and second configuration.

In particular, in the first configuration, the ornamental element of the article is covered and not visible while in the second configuration this ornamental element is uncovered and visible.

Other particularly simple and convenient features of the jewel and/or jewellery article according to the invention are described below.

The drive mechanism includes at least one drive rack formed by at least one toothed drive wheel and at least one toothed drive bar cooperating with the at least one toothed drive wheel and mechanically attached to the at least one movable flap, and the actuation mechanism includes an actuation rack formed by at least one toothed actuation bar and at least one toothed actuation wheel cooperating with the at least one toothed actuation bar and mechanically attached to the at least one toothed drive wheel.

The at least one toothed actuation wheel and the at least one toothed drive wheel are mounted coaxial on the frame.

The at least one toothed actuation wheel is positioned in an actuation plane comprising the second actuation direction, and the at least one toothed drive wheel is positioned in a drive plane offset from and parallel to the actuation plane.

The drive mechanism includes at least one catch forming a slide stop for the at least one toothed drive bar.

The actuation mechanism includes a gripping member attached to the toothed actuation bar.

The frame includes peripheral walls delimiting the frame and a central wall provided between the peripheral walls and having an ornament face and a face for mounting the actuation mechanism and the drive mechanism, opposite to the ornament face.

The central wall is provided, on its mounting face, with a main housing configured to receive the at least one toothed drive wheel and the at least one toothed actuation wheel, with at least one first channel extending from the main housing in the first drive direction and designed to receive the at least one toothed drive bar, and with at least one second channel extending from the main housing in the second actuation direction and designed to receive the at least one toothed actuation bar.

The peripheral wall includes at least one window for the at least one toothed drive bar to pass.

One of the frame and of the at least one flap has at least one rib and the other one of the frame and of the at least one flap has at least one groove configured to cooperate with the at least one rib for the at least one flap to slide with respect to the frame.

The toothed actuation bar has a first row of teeth on a first side of the toothed actuation bar and a second row of teeth on a second side of the toothed actuation bar opposite to the first side.

The article includes two flaps able to move in the first sliding direction and in opposite directions to pass from one to the other of the first position and second position.

The article includes a drive rack for each of the two flaps and in which the actuation mechanism comprises two toothed actuation wheels positioned in the same actuation plane and each attached axially to a toothed drive wheel of a respective drive rack, with the drive racks of the flaps being positioned respectively in a first drive plane offset from and parallel to the actuation plane and in a second drive plane offset from and parallel to the actuation plane, with the latter being interposed between the first and second drive planes.

BRIEF DESCRIPTION OF THE FIGURES

The invention, according to an example embodiment, will be well understood and the advantages thereof will appear best from a reading of the detailed description that follows, given by way of indication and in no way limitatively, with reference to the accompanying drawings.

DETAILED DESCRIPTION

The figures show a jewel and/or jewellery article 1, formed here by a pendant.

Figure 1:
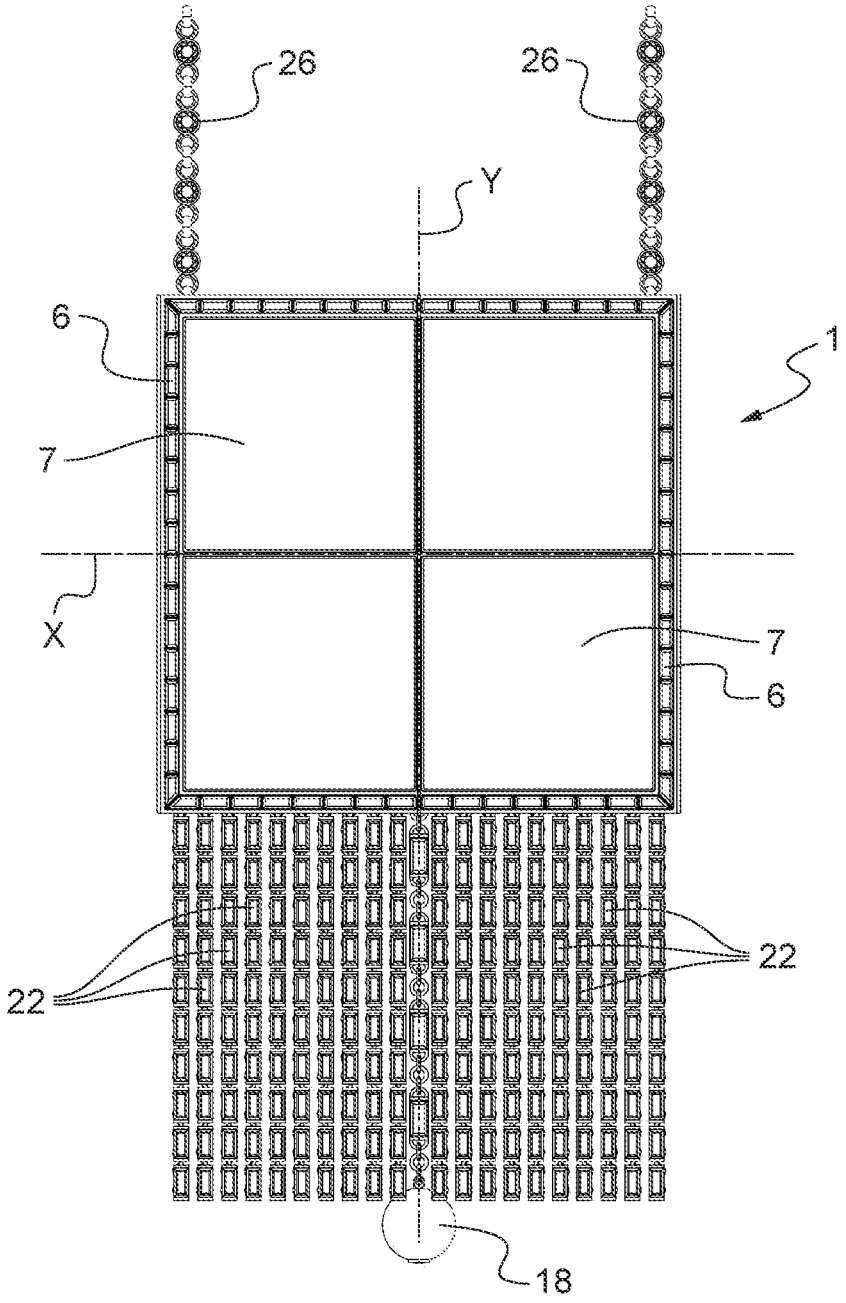
FIG. 1 shows in front view a jewel and/or jewellery article according to the invention, in a first configuration.
Figure 2:
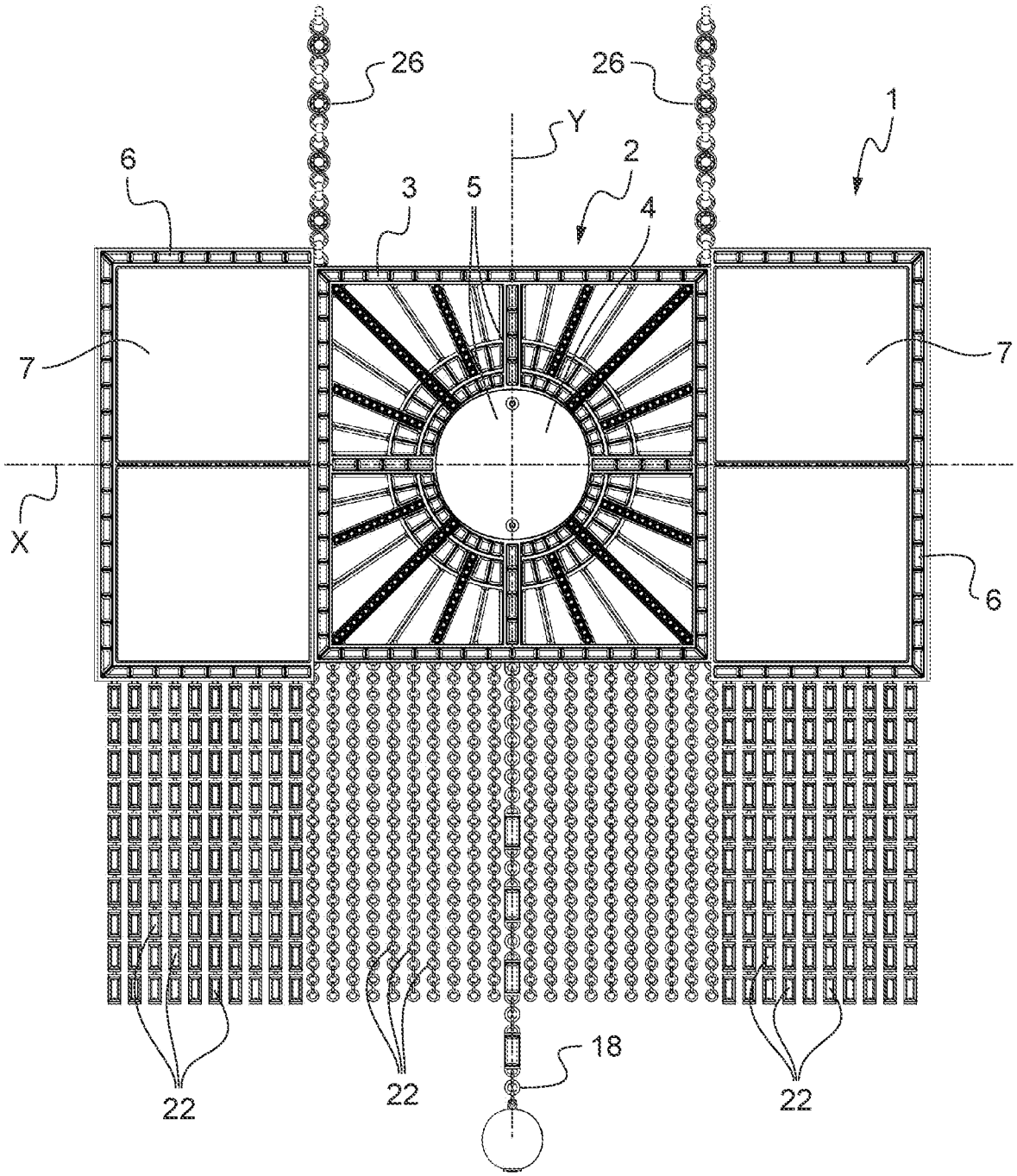
FIG. 2 is a view similar to FIG. 1, showing the article in a second configuration.

On FIG. 1, the pendant 1 is in a first configuration while on FIG. 2 the pendant 1 is in a second configuration.

The pendant 1 can for example be suspended from a chain 26 by means of one or more bows.

In its first configuration, the pendant 1 has at least one ornamental pattern 7 formed for example by an enamelled plate on FIG. 1.

In its second configuration, the pendant 1 furthermore has at least one ornamental pattern 5 formed for example by a strip of diamonds and/or a nacred plate on FIG. 2.

In the example illustrated, the pendant 1 furthermore includes ornamental fringes 22 that are suspended so as to form here a curtain of fringes 22.

The pendant 1 includes a gripping member 18 configured to cause the pendant 1 to pass from its first configuration to its second configuration when this gripping member 18 is urged in a direction Y referred to as the second actuation direction.

The pendant 1 includes a frame 2 provided with peripheral walls 3 that delimit the frame 2 and a central wall 4 provided between the peripheral walls 3.

The frame 2 has an ornament face on the front face of the article 1 and on which the at least one ornamental element 5 visible on FIG. 2 is mounted, which is here for example formed by precious stones arranged in a star pattern around a central ornamental piece.

The pendant 1 furthermore includes here two flaps 6 able to slide on and with respect to the frame 2 in a direction X referred to as the first drive direction.

The ornamental elements 7 are here mounted on the movable flaps 6, on the front face of the article 1.

In the first configuration of the pendant 1, the flaps 6 are in a first position in which they at least partially cover the frame 2 and therefore the ornamental element or elements 5.

In the second configuration of the pendant 1, the flaps 6 are in a second first position in which they at least partially uncover the frame 2 and the ornamental element or elements 5.

Between the first position and the second position of the flaps 6, the latter have been moved in the first drive direction X and in opposite directions.

Figure 3:
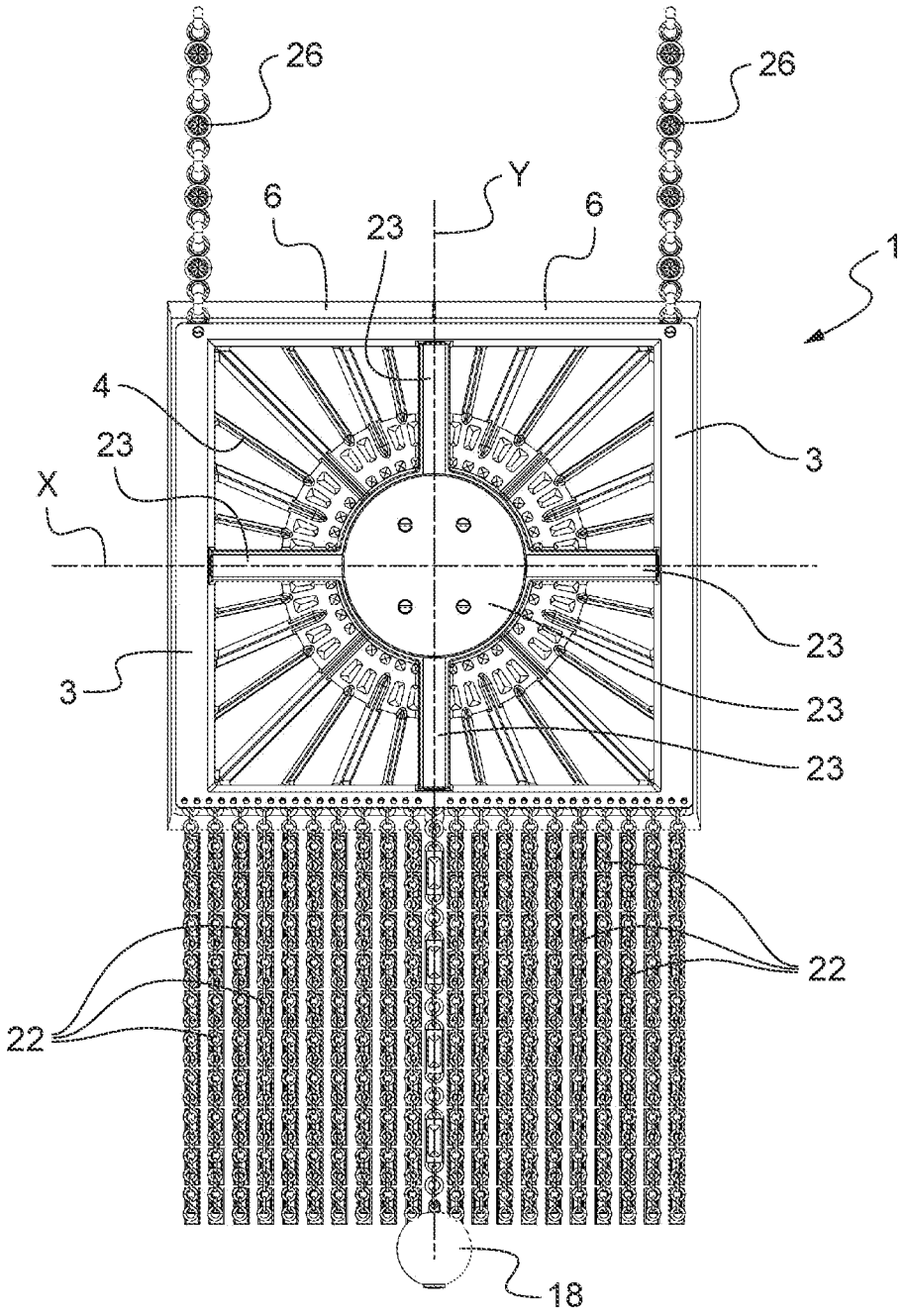
FIG. 3 is a view similar to the one in FIG. 1, taken in rear view and in a first configuration of the article.
Figure 4:
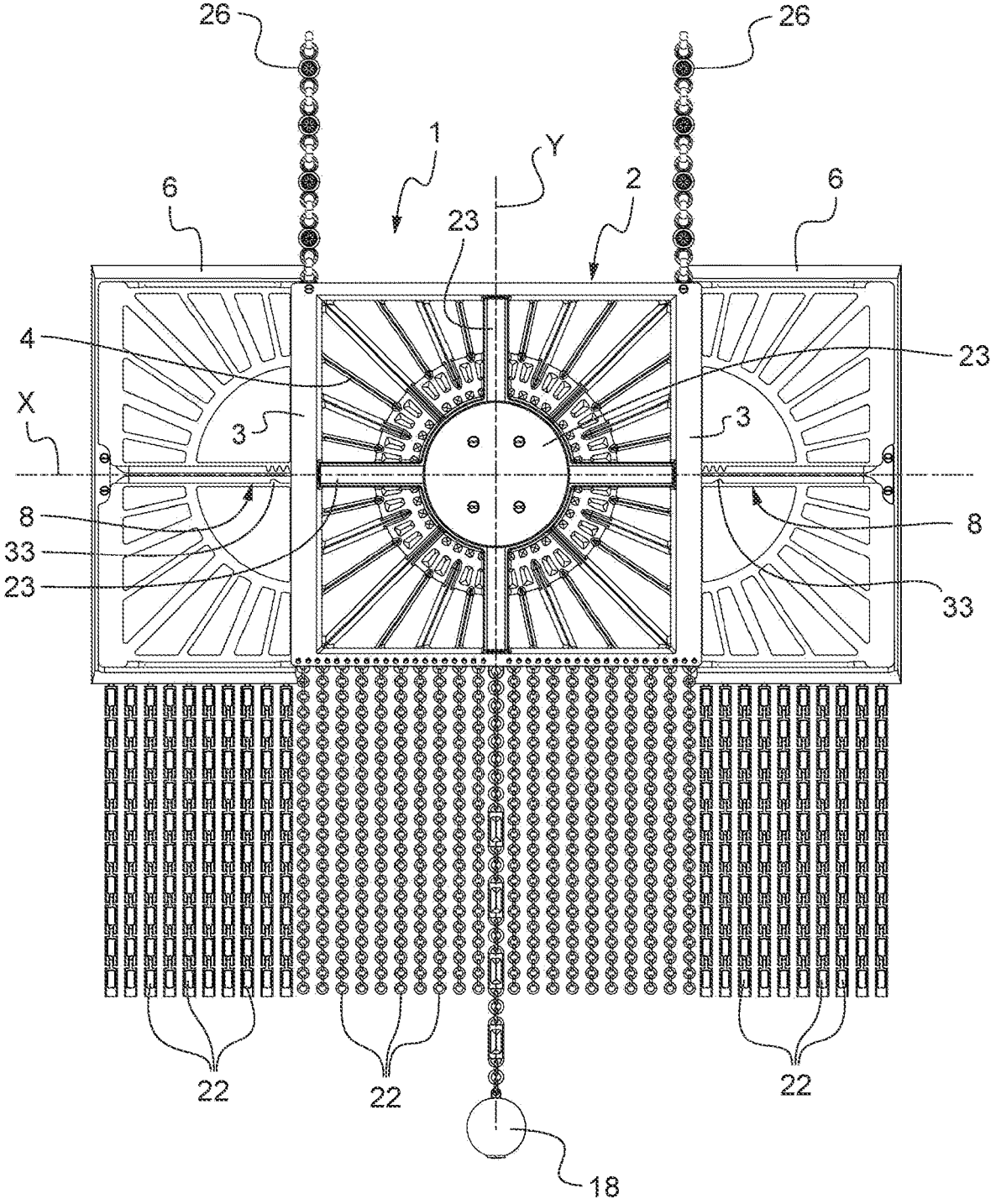
FIG. 4 is a view similar to the one in FIG. 2, taken in rear view and in a second configuration of the article.

As can be seen on FIGS. 3 and 4, which are similar to FIGS. 1 and 2, except that they show the pendant 1 in rear view, the central wall 4 of the frame 2 comprises a mounting face opposite to the ornament face and therefore on the rear face of the article 1.

The frame 2 is furthermore provided with covers 23 mechanically attached to the central wall 4, for example by screwing, thus partially masking the mounting face.

The covers 23 are designed to conceal the housings (see below) in which mechanisms are installed that make it possible to cause the pendant 1 to pass from one to the other of its first and second configurations.

The pendant 1 will now be described in more detail with reference to FIGS. 5 to 7, and in particular these mechanisms that make it possible to cause the pendant 1 to pass from one to the other of its first and second configurations.

In particular, the pendant 1 includes a drive mechanism 8 configured to make the flaps 6 slide on and with respect to the frame 2, as well as an actuation mechanism 9 configured to act on the drive mechanism 8.

The drive mechanism 8 is overall housed on the mounting face of the central wall 4 so that it is generally invisible. The actuation mechanism 9 is only partially housed on the mounting face of the central wall 4 so that it is only partially invisible.

Figure 5:
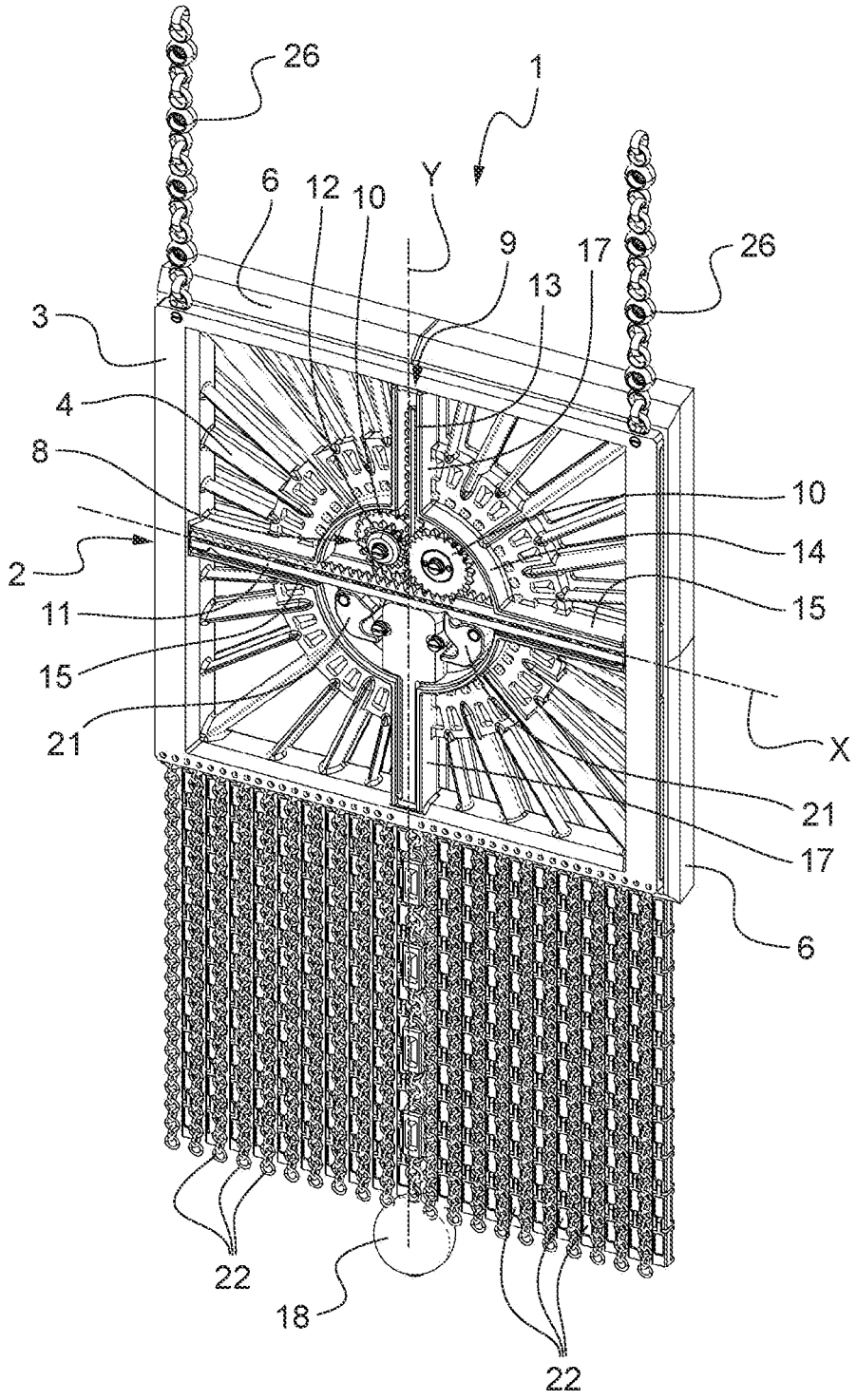
FIG. 5 is a view similar to the one in FIG. 3, but in perspective and rear view, with covers of the article omitted.
Figure 6:
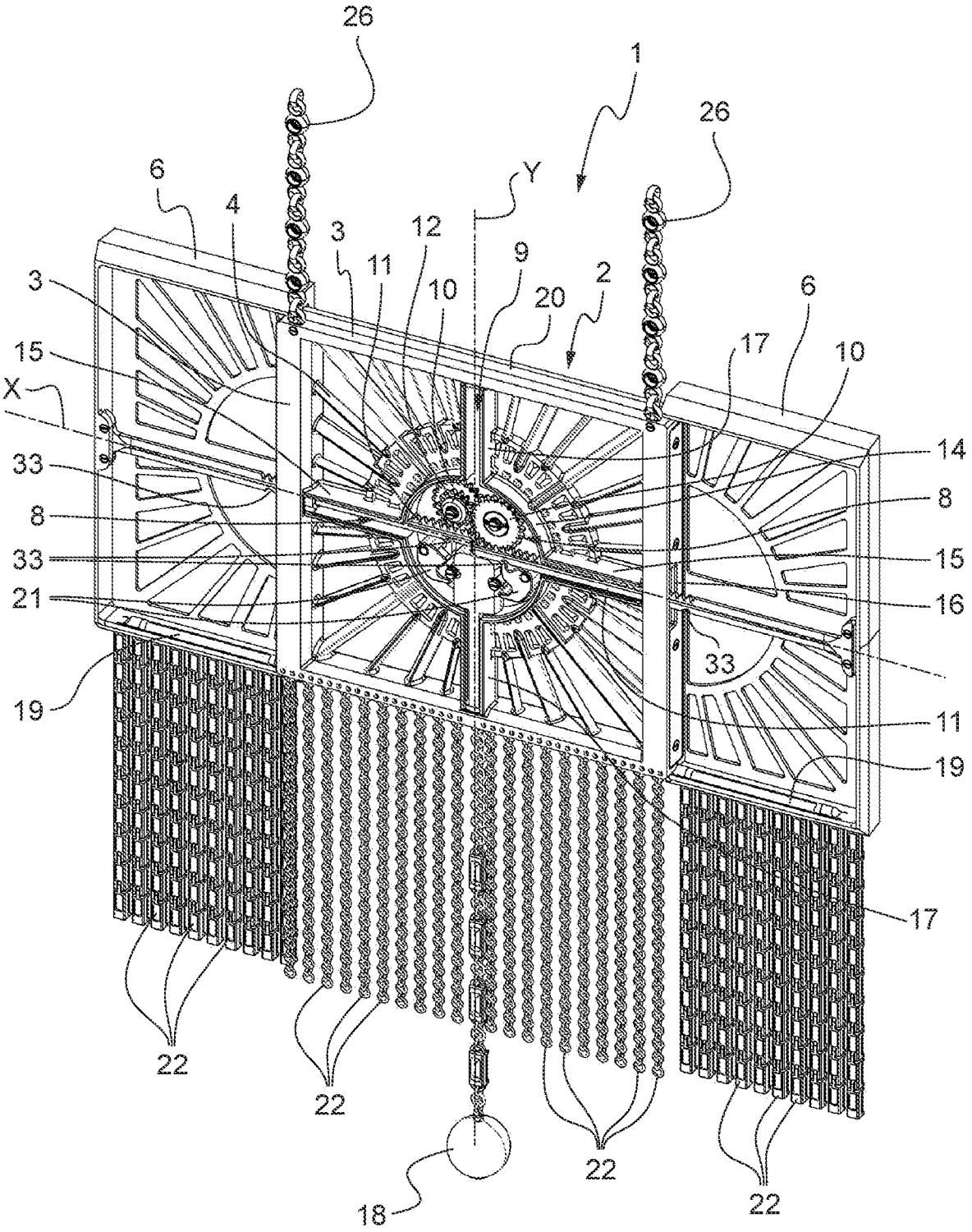
FIG. 6 is a view similar to the one in FIG. 4, but in perspective and rear view, with the covers of the article omitted.
Figure 7:
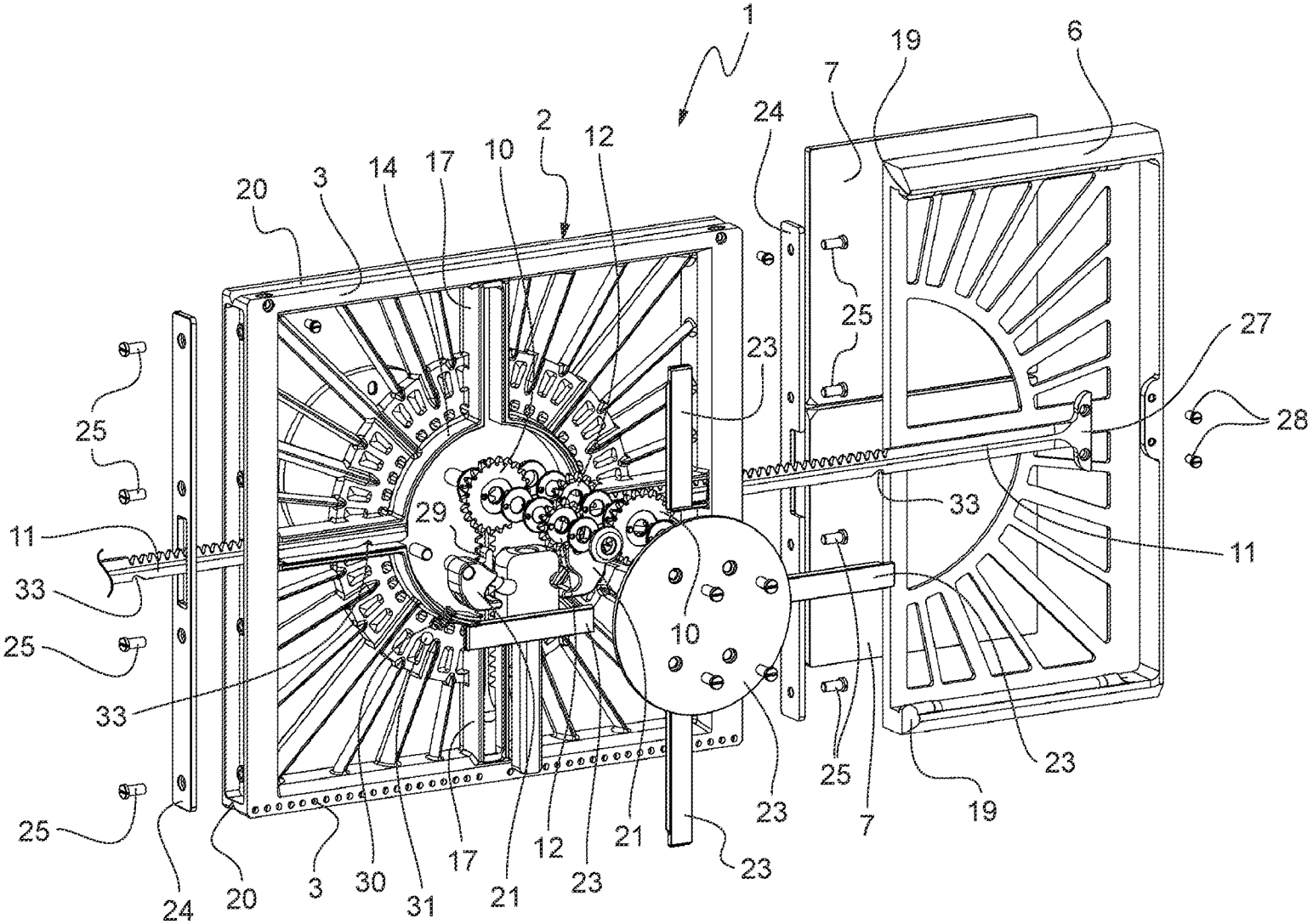
FIG. 7 is a partial view in exploded perspective, taken in rear view, of the article in FIGS. 1 to 6.

On FIGS. 5 and 6, the covers 23 have been omitted so as to completely see the drive mechanism 8 and the actuation mechanism 9.

The drive mechanism 8 includes a drive rack for each flap 6, said drive rack comprising a toothed drive wheel 10 and a toothed drive bar 11 configured to be moved by the action of the toothed drive wheel 10, because of the cooperation of teeth.

Each toothed drive bar 11 is attached to a respective flap 6.

For example, each toothed drive bar 11 is provided at a free end with a securing portion 27 that is secured, here by screwing, to an external edge of the flap 6, by screws 28.

The actuation mechanism 9 includes an actuation rack formed by a toothed actuation bar 13 and by two toothed actuation wheels 12 each cooperating with the toothed actuation bar and mechanically attached to one of the toothed drive wheels 10 of the drive mechanism.

The actuation mechanism 9 furthermore includes the gripping member 18 that is attached to one end the toothed actuation bar 13.

It should be noted that the toothed actuation wheels 12 and the toothed drive wheels can respectively include a countersink on opposite faces, each countersink being designed to receive a washer of the drive mechanism 8.

The drive mechanism may furthermore include a compensation washer between each pair of toothed drive wheel 10 and toothed actuation wheel 12, with the compensation washer being for example disposed on the same side as the toothed drive wheel 10 and which comes into abutment either on the central wall 4 or on a cover 23 covering the drive mechanism 8.

In the example illustrated, each toothed actuation wheel 12 has a diameter less than the toothed drive wheel 10 that is attached thereto.

The toothed drive wheels 10 and the toothed actuation wheel 12 that are attached thereto are mounted coaxial in rotation about a spindle (not shown) secured to the central wall 4 of the frame 2.

The frame 2 is provided with a main housing 14 provided in the central wall 4.

The main housing 14 has here a roughly circular shape.

In the example illustrated, the toothed drive wheels 10 and the toothed actuation wheel 12 are mounted so as to rotate in the main housing 14.

The frame 2 is furthermore provided with channels, referred to as first channels 15 and second channels 17, provided in the central wall 4.

The first channels 15 and second channels 17 have here a substantially U shape.

The first channels 15 and second channels 17 extend here from the main housing as far as the peripheral walls 3.

The first channels 15 extend in the first drive direction X.

The second channels 17 extend in the second actuation direction Y.

In the example illustrated, the frame 2 has a pattern formed by a plurality of radii extending from the main housing 14 as far as the peripheral walls 3, and between the first channels 15 and the second channels 17, thus making the central wall 4 perforated.

The toothed actuation bar 13 of the actuation mechanism 9 and the two toothed drive bars 11 are mounted so as to be able to slide respectively in both of the two second channels 17 and in the first channels 15.

The peripheral walls 3 that extend in the second actuation direction Y are each provided with a plate 24 in which a window 16 is formed, located facing one end of a respective first channel 15.

Each of the two toothed drive bars 11 is configured to pass through a respective window 16 when it is slid.

The plates 24 are here for example screwed onto the peripheral walls 13 by screws 25.

In the example illustrated, only one of the two channels 17 emerges on a window (not shown) provided in one of the peripheral walls 3, on the side where the gripping member 18 is located.

The actuation mechanism 9 may include a guide member 32 mounted in the only one of the two channels 17 that emerges on a window provided in one of the peripheral walls 3, on the side where the gripping member 18 is located, and also in the main housing 14.

The guide member 32 may be formed by a through longitudinal orifice into which the toothed actuation part 13 of the actuation mechanism 9 can be introduced so as to be able to slide.

In the example illustrated, the toothed actuation wheels 12 are positioned side by side in the main housing 14, in one and the same actuation plane comprising the actuation direction Y, and on either side of the toothed actuation bar 13.

The toothed actuation bar 13 has a first row of teeth on a first side of the toothed actuation bar 13 and a second row of teeth on a second side of the toothed actuation bar 13 opposite to the first side.

More simply, it can be said that the toothed actuation bar 13 is doubly serrated.

Thus the toothed actuation bar 13 configured to cooperate both with the two toothed actuation wheels 12, the first row of teeth cooperating with one of the two toothed actuation wheels 12, in the second row of teeth cooperating with the other one of the two toothed actuation wheels 12.

In the example illustrated, the toothed drive wheels 10 and the toothed drive bars 11 are for their part positioned, in pairs, respectively in a first drive plane offset from and parallel to the actuation plane and in a second drive plane offset from and parallel to the actuation plane, with the latter being interposed between the first and second drive planes.

In other words, this means that the windows 16 are also arranged so as to be offset with respect to each other and to be located in the first drive plane and respectively in the second drive plane.

In the example illustrated, one of the two windows 16 is centred on the respective plate 24 while the other window 16 is offset on the respective plate 24 and forms an open window or, in other words, a recess on this plate.

The drive mechanism 8 includes here two catches 21 forming a slide stop for the toothed drive bars 11.

The catches 21 are mounted in the central housing 14 and are each provided with a locking finger 29 projecting towards the toothed drive bars 11.

Each of the toothed drive bars 11 for its part includes, opposite to their teeth, notches 33 provided roughly at the opposite ends of the toothed drive bars 11, and configured to each receive the locking finger 29 of a respective catch 21.

In particular, the notches 33 are located so as to provide, in cooperation with the locking fingers 29 of the catches 21, a first stop in the first configuration of the article, with the flaps 6 in their first position, and a second stop in the second configuration of the article, with the flaps in their second position (see below).

The catches 21 are mounted so as to pivot in the central housing 14 and provided with return members configured to urge the catches into a stable position in which the respective locking fingers 29 are located in respective notches 33.

For example, the return members are each formed by a spring 30 sitting at one end on a ball 31 against an edge of the central housing 14 and in contact with the catch 21 at an opposite end.

As explained above, the flaps 6 are mounted so as to be able to slide on and with respect to the frame 2 and in particular with respect to so-called top and bottom peripheral walls 3.

The frame 2 is provided with ribs and/or grooves 20 on its so-called top and bottom peripheral walls 3, while each of the flaps 6 is provided with so-called top and bottom grooves and/or ribs 19 and which are each designed to receive a respective rib and/or groove 20, so as to form for example a connection of the slider type.

In the example illustrated, the frame is provided with a rib on its top peripheral wall and with a groove on its bottom peripheral wall, while the flaps are provided with top grooves cooperating with the rib of the top peripheral wall of the frame and with bottom ribs cooperating with the groove of the bottom peripheral wall of the frame.

The change from one to the other of the first and second configurations of the pendant 1 and therefore from one to the other of the first and second positions of the flaps 6 will now be described.

When the pendant 1 is in the first configuration, the flaps 6 are in the first position in which they globally cover the frame 2.

The ornamental element 5 of the frame 2 is then globally masked.

In the first position of the flaps 6, the actuation mechanism 9 is also in a first position in which the toothed actuation bar 13 is retracted inside the frame 2, in the main housing 14 and in one of the two second channels 17, and in particular the one that does not emerge in a window.

In the first position of the flaps 6, the drive mechanism 8 is also in a first position in which the toothed drive bars 11 are retracted inside the frame 2, in the main housing 14 and in the first channels 15, with the locking finger 29 of each catch 21 being located in a respective notch 33 of the respective toothed drive bar 11.

For the pendant 1 to pass into its second configuration, the gripping member 18 is urged, here downwards away from the frame 2, so as to drive in translation also downwards, in the second actuation direction than Y.

The toothed actuation bar 13 slides through the main housing 14, from the second channel 17 that does not emerge in a window towards the other second channel 17 that does emerge in a window.

Thus the toothed actuation bar 13 slides in the guide member 32.

The movement of the toothed actuation bar 13 sets in rotation the toothed actuation wheels 12, which themselves set in rotation the toothed drive wheels 10 of the drive mechanism 8.

The rotation of the toothed drive wheels 10 sets in rotation the toothed drive bars 11, which then slide in the first channels 15, away from each other and in the first drive direction X.

It should be noted that the actuation of the gripping member 18 must be sufficient to enable the toothed drive bars 11 to slightly move the catches 21 and thus make the respective locking fingers 29 emerge from the respective notches 33.

The sliding of the toothed actuation bars 13 thus moves the flaps 6 that are secured to them.

The flaps 6 slide on the frame 2 by means of the slider connection formed by the cooperation of the ribs and grooves.

The flaps 6 pass from their first position to their second position until the respective locking fingers 29 of the catches 21 enter the respective opposite notches 33 of the toothed drive bars 11.

The pendant 1 is then in the second configuration, with the flaps 6 globally uncovering the frame 2 and the ornamental element 5 of the frame 2, which is revealed and visible on the ornament face of the frame 2.

It should be noted that, in the example illustrated, the reverse passage from the second configuration to the first configuration of the pendant 1 is done manually by directly acting on the flaps 6.

This makes it possible to drive in the reverse direction, i.e. to bring together the toothed drive bars 11, to set in rotation in the reverse direction the toothed drive wheels 10 and the toothed actuation wheels 12, and thus to raise the toothed actuation bar 13 and the gripping member 18.

In a variant that is not illustrated, the actuation mechanism may include a device for locking/unlocking the position of the gripping member, provided in particular with a return spring for returning the flaps to their first position without external action.

Other variants that are not illustrated are described below.

The pendant may comprise more or fewer additional ornamental elements.

The frame and/or the flaps may be of any other shape than square, for example polygonal or circular.

The flaps may be of any other shape than rectangular, for example polygonal or semicircular.

The pendant may comprise a single flap, more than two, or more flaps.

The drive mechanism may include a single toothed drive bar and a single toothed drive wheel, or on the contrary more than two toothed drive bars and toothed drive wheels.

The catch as described above may be replaced by a catch of another type, including a body in which there are housed a spring and a ball configured to be at least partially introduced into a complementary hollow.

The catch may furthermore be located otherwise than in the central housing and/or act on the flaps rather than on the toothed drive bars.

The jewel and/or jewellery article may be an article other than a pendant, and may be worn on the wrist or on the ear, or also attached to a support, for example a wall support or any other support.

The jewel and/or jewellery article may also be incorporated in another article, such as for example a leatherwork article or a textile article.

It is stated more generally that the invention is not limited to the examples described and shown.

The invention claimed is:

1. A jewelry article comprising:

a frame and at least one flap able to move with respect to the frame, with the jewelry article being configured to admit a first configuration wherein the at least one flap at least partially covers the frame and at least one ornamental element that the frame includes, and second configuration wherein the at least one flap at least partially uncovers the frame and said at least one ornamental element, a drive mechanism configured to cause the at least one flap to slide in translation on the frame, in a first sliding direction, between a first position in the first configuration of the jewelry article and a second position in the second configuration of the jewelry article, and an actuation mechanism configured to act on the drive mechanism when the actuation mechanism is urged manually in a second actuation direction different from the first sliding direction.

2. The jewelry article according to claim 1, wherein the drive mechanism includes at least one drive rack formed by at least one toothed drive wheel and at least one toothed drive bar cooperating with the at least one toothed drive wheel and mechanically attached to the at least one flap, and the actuation mechanism includes an actuation rack formed by at least one toothed actuation bar and at least one toothed actuation wheel cooperating with the at least one toothed actuation bar and mechanically attached to the at least one toothed drive wheel.

3. The jewelry article according to claim 2, wherein the at least one toothed actuation wheel and the at least one toothed drive wheel are mounted coaxial on the frame.

4. The jewelry article according to claim 3, wherein the at least one toothed actuation wheel is positioned in an actuation plane comprising the second actuation direction, and the at least one toothed drive wheel is positioned in a drive plane offset from and parallel to the actuation plane.

5. The jewelry article according to claim 3, wherein the drive mechanism includes at least one catch forming a slide stop for the at least one toothed drive bar.

6. The jewelry article according to claim 3, wherein the actuation mechanism includes a gripping member attached to the toothed actuation bar.

7. The jewelry article according to claim 3, wherein the frame includes peripheral walls delimiting the frame and a central wall provided between the peripheral walls and having an ornament face and a face for mounting the actuation mechanism and the drive mechanism, opposite to the ornament face.

8. The jewelry article according to claim 2, wherein the at least one toothed actuation wheel is positioned in an actuation plane comprising the second actuation direction, and the at least one toothed drive wheel is positioned in a drive plane offset from and parallel to the actuation plane.

9. The jewelry article according to claim 2, wherein the drive mechanism includes at least one catch forming a slide stop for the at least one toothed drive bar.

10. The jewelry article according to claim 2, wherein the actuation mechanism includes a gripping member attached to the toothed actuation bar.

11. The jewelry article according to claim 2, wherein the frame includes peripheral walls delimiting the frame and a central wall provided between the peripheral walls and having an ornament face and a face for mounting the actuation mechanism and the drive mechanism, opposite to the ornament face.

12. The jewelry article according to claim 11, wherein the central wall is provided, on a mounting face thereof, with a main housing configured to receive the at least one toothed drive wheel and the at least one toothed actuation wheel, with at least one first channel extending from the main housing in the first sliding direction and designed to receive the at least one toothed drive bar, and with at least one second channel extending from the main housing in the second actuation direction and designed to receive the at least one toothed actuation bar.

13. The jewelry article according to claim 12, wherein the peripheral walls include at least one window for the at least one toothed drive bar to pass.

14. The jewelry article according to claim 12, wherein one of the frame and of the at least one flap has at least one rib and the other one of the frame and of the at least one flap has at least one groove configured to cooperate with the at least one rib for the at least one flap to slide with respect to the frame.

15. The jewelry article according to claim 11, wherein the peripheral walls include at least one window for the at least one toothed drive bar to pass.

16. The jewelry article according to claim 11, wherein one of the frame and of the at least one flap has at least one rib and the other one of the frame and of the at least one flap has at least one groove configured to cooperate with the at least one rib for the at least one flap to slide with respect to the frame.

17. The jewelry article according to claim 2, wherein the toothed actuation bar has a first row of teeth on a first side of the toothed actuation bar and a second row of teeth on a second side of the toothed actuation bar opposite to the first side.

18. The jewelry article according to claim 17, wherein said at least one flap comprises two flaps able to move in the first sliding direction and in opposite directions to pass from one to the other of the first position and second position.

19. The jewelry article according to claim 18, wherein said at least one drive rack comprises a drive rack for each of the two flaps and wherein said at least one actuation wheel comprises two toothed actuation wheels positioned in the same actuation plane and each attached axially to a toothed drive wheel of a respective drive rack, with the drive racks of the flaps being positioned respectively in a first drive plane offset from and parallel to the actuation plane and in a second drive plane offset from and parallel to the actuation plane, with the latter being interposed between the first and second drive planes.

20. A jewelry article comprising:

a frame and at least one flap able to move with respect to the frame, with the jewelry article being configured to admit a first configuration wherein the at least one flap at least partially covers the frame and at least one ornamental element that the frame includes, and a second configuration wherein the at least one flap at least partially uncovers the frame and said at least one ornamental element, a drive mechanism configured to cause the at least one flap to slide on the frame, in a first sliding direction, between a first position in the first configuration of the jewelry article and a second position in the second configuration of the jewelry article, and an actuation mechanism configured to act on the drive mechanism when the actuation mechanism is urged in a second actuation direction different from the first sliding direction;

wherein the drive mechanism includes at least one drive rack formed by at least one toothed drive wheel and at least one toothed drive bar cooperating with the at least one toothed drive wheel and mechanically attached to the at least one flap, and the actuation mechanism includes an actuation rack formed by at least one toothed actuation bar and at least one toothed actuation wheel cooperating with the at least one toothed actuation bar and mechanically attached to the at least one toothed drive wheel.

* * * * *